US008657635B2

(12) United States Patent
Koyama et al.

(10) Patent No.: US 8,657,635 B2
(45) Date of Patent: Feb. 25, 2014

(54) TERMINAL AND CONNECTOR USING THE SAME

(75) Inventors: Jiro Koyama, Otsu (JP); Hirotada Teranishi, Kusatsu (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 63 days.

(21) Appl. No.: 13/260,771

(22) PCT Filed: Mar. 24, 2011

(86) PCT No.: PCT/JP2011/057168

§ 371 (c)(1),
(2), (4) Date: Sep. 28, 2011

(87) PCT Pub. No.: WO2012/056746

PCT Pub. Date: May 3, 2012

(65) Prior Publication Data

US 2012/0108111 A1 May 3, 2012

(30) Foreign Application Priority Data

Oct. 29, 2010 (JP) ..... 2010-244120

(51) Int. Cl.
*H01R 4/48* (2006.01)

(52) U.S. Cl.
USPC ..... 439/862; 439/500; 439/700

(58) Field of Classification Search
USPC ..... 439/474, 500, 700, 862
See application file for complete search history.

(56) References Cited

U.S. PATENT DOCUMENTS

| | | | | |
|---|---|---|---|---|
| 5,100,338 | A * | 3/1992 | Lu | 439/326 |
| 5,286,208 | A * | 2/1994 | Matsuoka | 439/72 |
| 7,364,434 | B2 * | 4/2008 | Hu et al. | 439/66 |
| 7,557,595 | B2 * | 7/2009 | Chen et al. | 324/755.07 |
| 7,679,388 | B2 * | 3/2010 | Chen et al. | 324/755.07 |
| 8,100,731 | B2 * | 1/2012 | Koyama et al. | 439/862 |
| 8,197,290 | B2 * | 6/2012 | Koyama et al. | 439/862 |
| D665,361 | S * | 8/2012 | Koyama et al. | D13/154 |
| 2006/0246746 | A1 * | 11/2006 | Hu et al. | 439/66 |
| 2012/0108111 | A1 * | 5/2012 | Koyama et al. | 439/746 |
| 2012/0171905 | A1 * | 7/2012 | Koyama et al. | 439/676 |
| 2012/0238141 | A1 * | 9/2012 | Koyama et al. | 439/625 |

FOREIGN PATENT DOCUMENTS

| | | | |
|---|---|---|---|
| JP | 2000-338133 | A | 12/2000 |
| JP | 2001-237015 | A | 8/2001 |
| JP | 3120893 | U | 4/2006 |

OTHER PUBLICATIONS

International Search Report from PCT/JP2011/057168 dated May 10, 2011 (2 pages).
Written Opinion from PCT/JP2011/057168 dated May 10, 2011 (3 pages).

* cited by examiner

*Primary Examiner* — James Harvey
(74) *Attorney, Agent, or Firm* — Osha Liang LLP

(57) ABSTRACT

A terminal configured to be pressed into and fixed to a base material has a press-fit fixing portion configured to be pressed into the base material, a branch portion extending from the press-fit fixing portion, a plurality of extension portions that extend from the branch portion in a meandering manner, such that at least one meandering slit is formed thereby, a tip portion integrated with a free end of the extension portion, and a movable contact portion formed on the tip portion that is configured to protrude out of a contacting hole of the base material so as to be taken in and out.

19 Claims, 15 Drawing Sheets

Fig. 9 ( A )
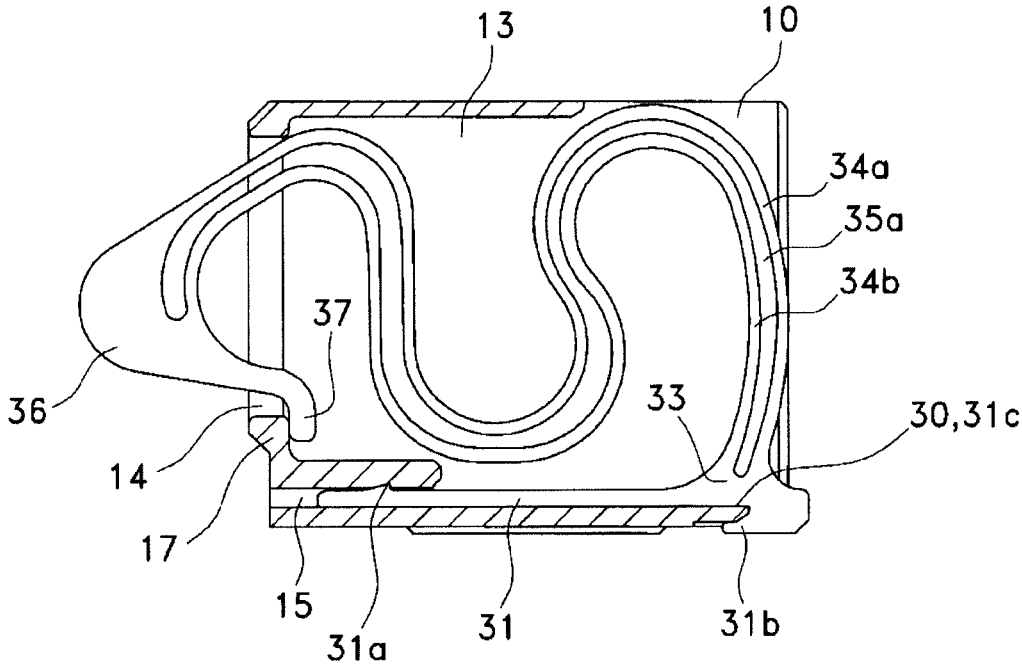
Fig. 9 ( B )
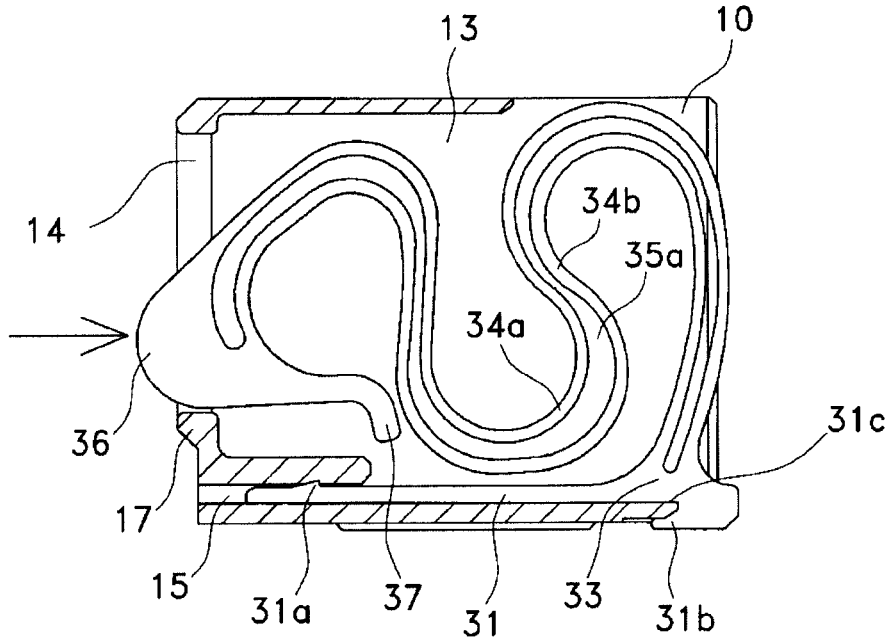

TERMINAL AND CONNECTOR USING THE SAME

TECHNICAL FIELD

The present invention relates to a terminal, for example, a terminal which is not only incorporated in a housing to configure a connector, but also directly mounted on a board for use.

BACKGROUND ART

Conventionally, as a terminal, for example, there is a contact for an IC socket in which a terminal contact portion is integrally formed via a spring side portion in which a base portion is connected to a support side portion, characterized in that the spring side portion is formed into an approximately lateral U shape which is configured by an upper side arm extending from a coupling portion to the terminal contact portion and a lower side arm extending from the coupling portion to the base portion, the upper side arm is configured by a first spring portion and a second spring portion which are extended away from and in parallel with each other, the lower side arm is configured by a third spring portion and a fourth spring portion which are extended away from and in parallel with each other, and the sprig side portion is formed into an inclined shape which slopes down from the coupling portion to the base portion (refer to Patent Document 1).

PATENT DOCUMENT

Patent Document 1: Japanese Unexamined Patent Publication No. 2001-237015

SUMMARY OF THE INVENTION

However, in the contact for an IC socket mentioned above, for example, as shown in FIG. 4 of Patent Document 1, a linear upper side arm 2 and a linear lower side arm 3 are connected by a coupling portion 8. Accordingly, since it is impossible to make a spring length long, and it is hard to secure a predetermined contact pressure, high contact reliability cannot be obtained, and stress concentration easily occur in the coupling portion 8, so that a service life is short.

The terminal according to one or more embodiments of the present invention provides a terminal which can secure a predetermined contact pressure by securing a long spring length, is high in contact reliability, is hard to generate stress concentration, and has a long service life.

A terminal according to one or more embodiments of the present invention is structured such that in a terminal used by being pressed into and fixed to a base material, at least one meandering slit is formed by extending a plurality of extension portions while meandering from a branch portion provided in a press-fit fixing portion which is pressed into the base material, and a tip portion with which a free end of the extension portion is integrated is provided with a movable contact portion which protrudes out of a contacting hole of the base material so as to be taken in and out.

According to one or more embodiments of the present invention, since the spring length becomes long and a plurality of springs overlap in a movable direction, a predetermined contact pressure can be easily obtained, and contact reliability is improved. Further, stress concentration is hard to be generated, and a terminal having a long service life can be obtained.

One or more embodiments the present invention may be structured such that the branch portion is provided in an end of a support portion which is provided in a protruding manner in such a manner as to intersect the press-fit fixing portion.

According to one or more embodiments, since the spring length becomes longer at a length of the support portion, contact reliability is further improved.

According to one or more embodiments of the present invention, the support portion may be curved.

According to one or more embodiments, the spring length becomes further longer, and the contact reliability is improved. In particular, if the support portion is curved in an outer direction, it becomes hard to come into contact with the other extension portions at the time of operating, a movable contact portion having a greater amount of displacement can be obtained, and a terminal which is excellent in shock resistance can be obtained.

According to one or more embodiments of the present invention, three extension portions may be extended from the branch portion.

According to one or more embodiments, it is possible to disperse a stress, durability is improved, and a terminal having a low electric resistance value can be obtained.

One or more embodiments of the present invention may be structured such that one end portions of first, second, and third extension portions extending from the branch portion are positioned on the same straight line.

According to one or more embodiments, since the support points of the first, second, and third extension portions are aligned on the same straight line, a stress analysis becomes easy and a design becomes easy.

One or more embodiments of the present invention may be structured such that a first extension portion and a second branch portion extend from a first branch portion which is provided in the press-fit fixing portion, and a second extension portion and a third extension portion extend from the second branch portion.

According to one or more embodiments, since a number of extension portions do not extend from one branch portion, stress concentration becomes hard to be generated, and a terminal in which a service life is further longer can be obtained.

One or more embodiments of the present invention may be structured such that the adjacent extension portions extend in parallel. In particular, a width dimension of a slit may be such a width dimension that the adjacent extension portions do not come into contact with each other at the time of operating.

According to one or more embodiments, uncomfortable contact sound is not generated at the time of operating.

One or more embodiments of the present invention may be structured such that a tip portion with which the extension portion is integrated is provided in a protruding manner with a position regulating protrusion portion which comes into contact with a position regulating receiving portion of the base material. Further, the tip portion with which the extension portion is integrated may be provided with a position regulating contact portion which comes into contact with the position regulating receiving portion of the base material.

According to one or more embodiments, since it is possible to accurately position the movable contact portion of the terminal at a predetermined position, operating characteristics is improved.

A connector according to one or more embodiments of the present invention is structured such that the press-fit fixing portion of the terminal described above is pressed into a press-fit hole of a housing serving as the base material so as to be fixed, and a movable contact portion of the terminal protrudes out of a contacting hole provided in the housing so as to be taken in and out.

According to one or more embodiments of the present invention, it is possible to obtain a connector in which contact reliability is high and a service life is long.

One or more embodiments of the present invention may be structured such that a position regulating protrusion portion which is provided in a protruding manner around a movable contact portion of the terminal is brought into contact with a position regulating receiving portion which is provided in an opening edge portion of the contacting hole of the housing so as to be positioned. Further, it may be structured such that a position regulating contact portion which is provided around a movable contact portion of the terminal is brought into contact with a position regulating receiving portion which is provided in an opening edge portion of the contacting hole of the housing so as to be positioned.

According to one or more embodiments, since it is possible to position the movable contact portion of the terminal with high positioning precision, there is such an effect that the connector having no variation in the operating characteristics can be obtained.

BRIEF DESCRIPTION OF THE DRAWINGS

FIGS. 9A and 9B are cross sectional views showing before and after a motion of the terminal according to the third embodiment.

DETAILED DESCRIPTION

Figure 1:
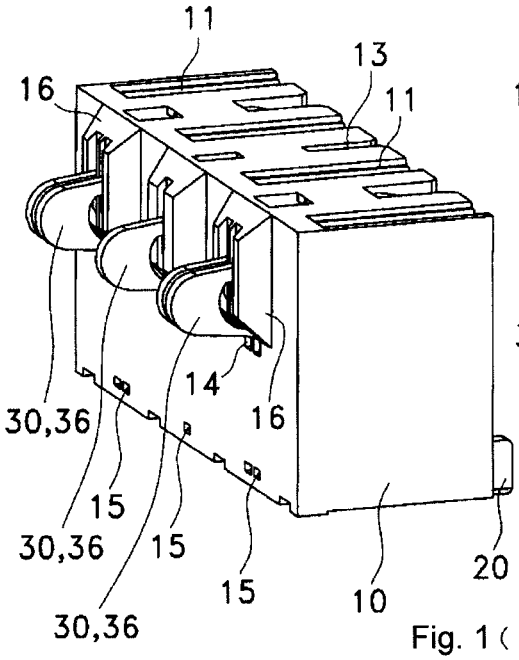
FIGS. 1A, 1B and 1C are a perspective view, a cross sectional perspective view and a plan view each showing a connector in which a terminal according to a first embodiment of the present invention is incorporated.
Figure 1:
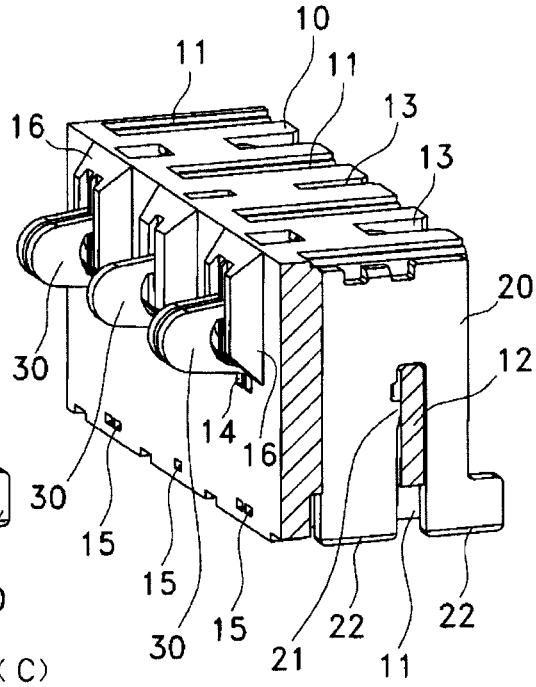
Figure 1:
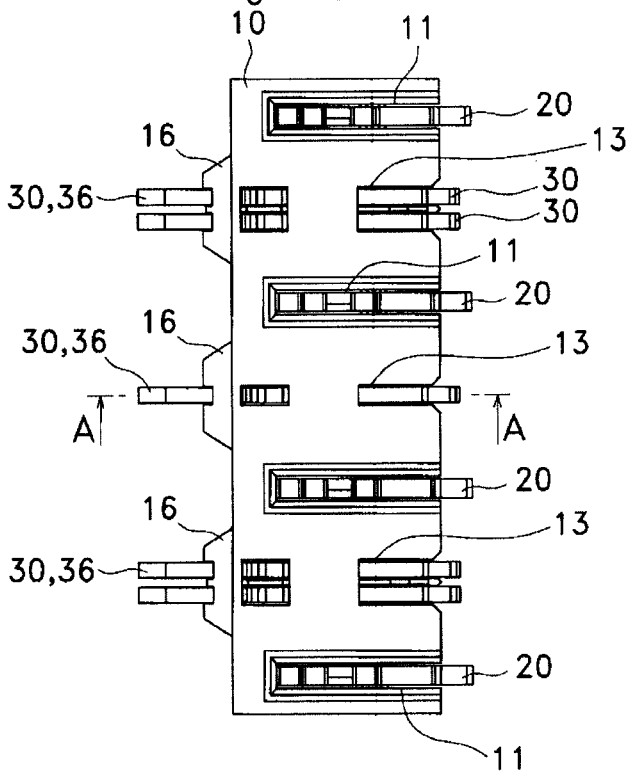
Figure 2:
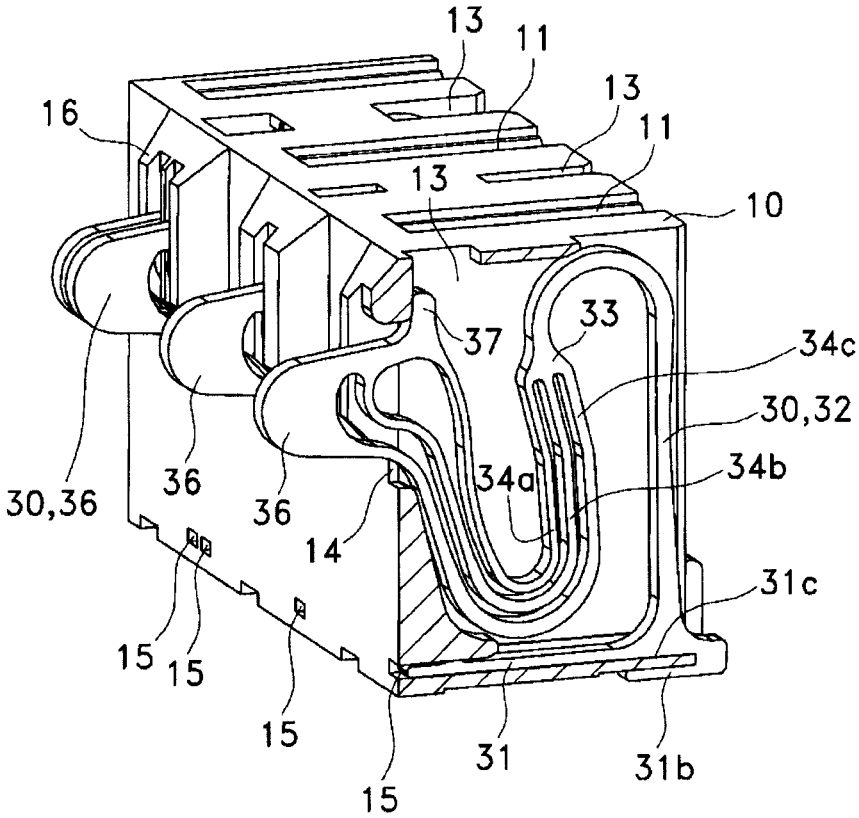
FIGS. 2A and 2B are a cross sectional perspective view of the connector in which the terminal according to the first embodiment illustrated in FIGS. 1A, 1B and 1C is incorporated, and a perspective view of a simple substance of the terminal.
Figure 2:
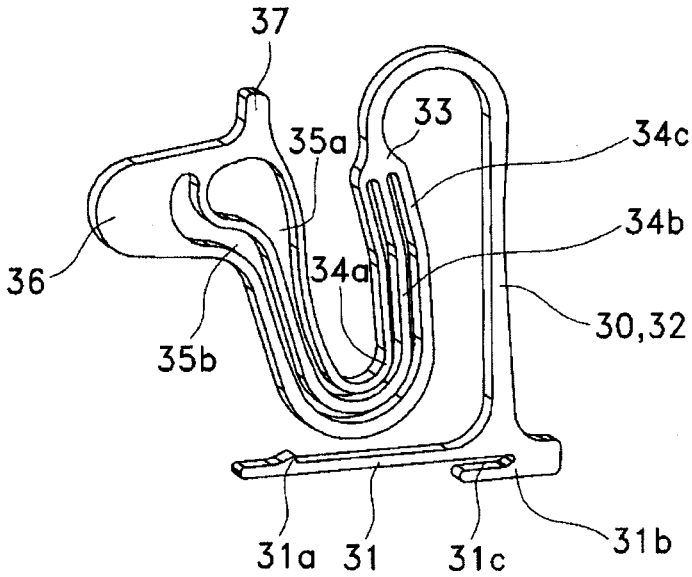
Figure 3:
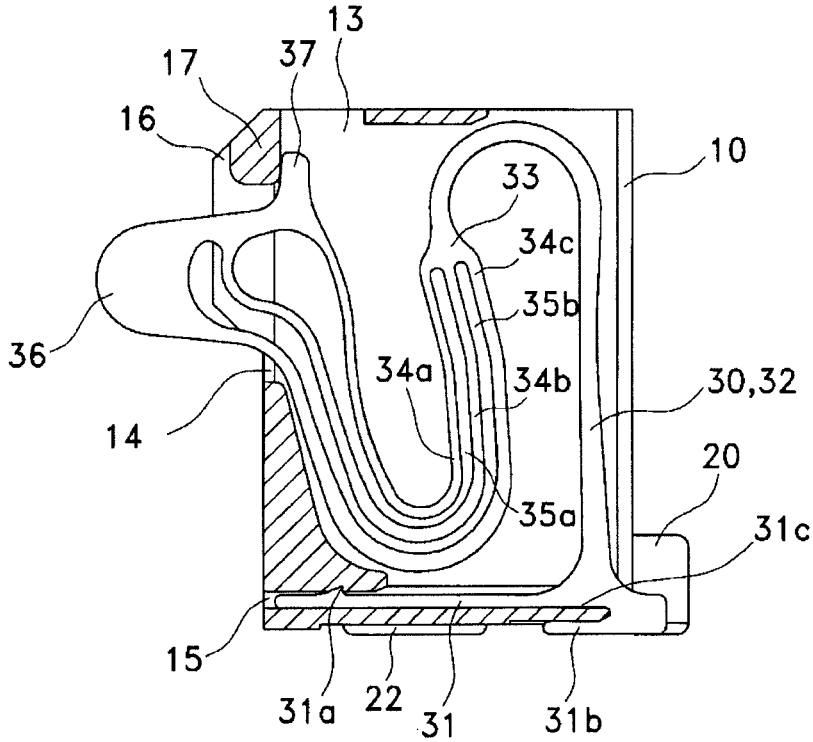
FIGS. 3A and 3B are cross sectional views showing before and after a motion of the terminal according to the first embodiment.
Figure 3:
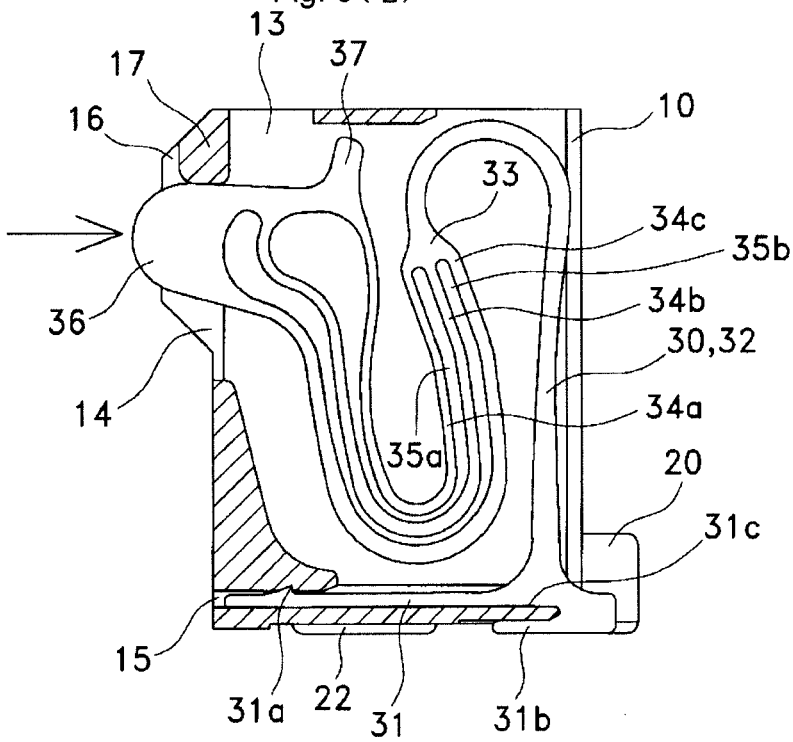
Figure 4:
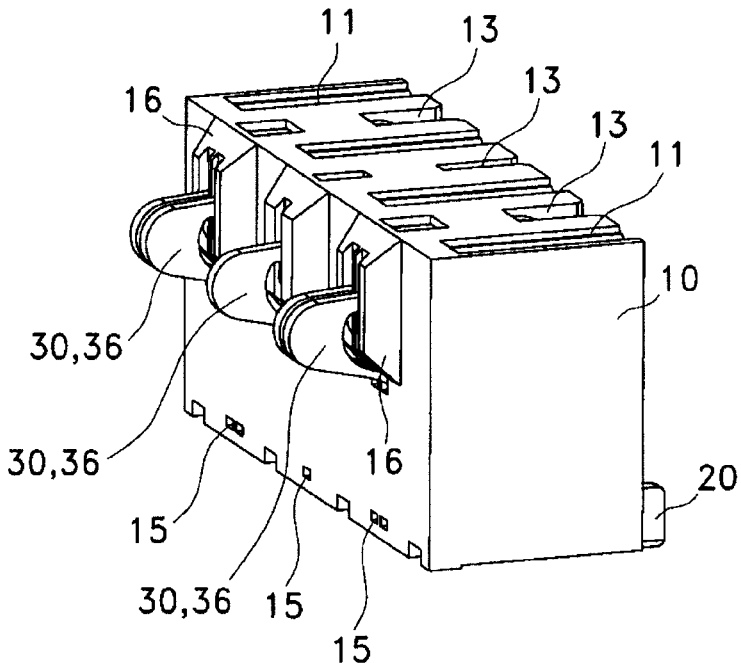
FIGS. 4A and 4B are a perspective view and a plan view each showing a connector in which a terminal according to a second embodiment of the present invention is incorporated.
Figure 4:
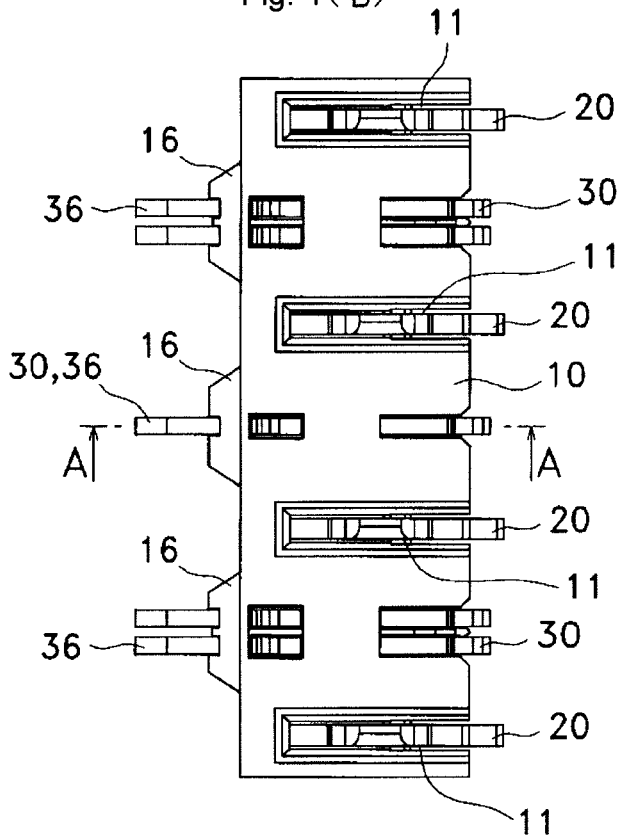
Figure 5:
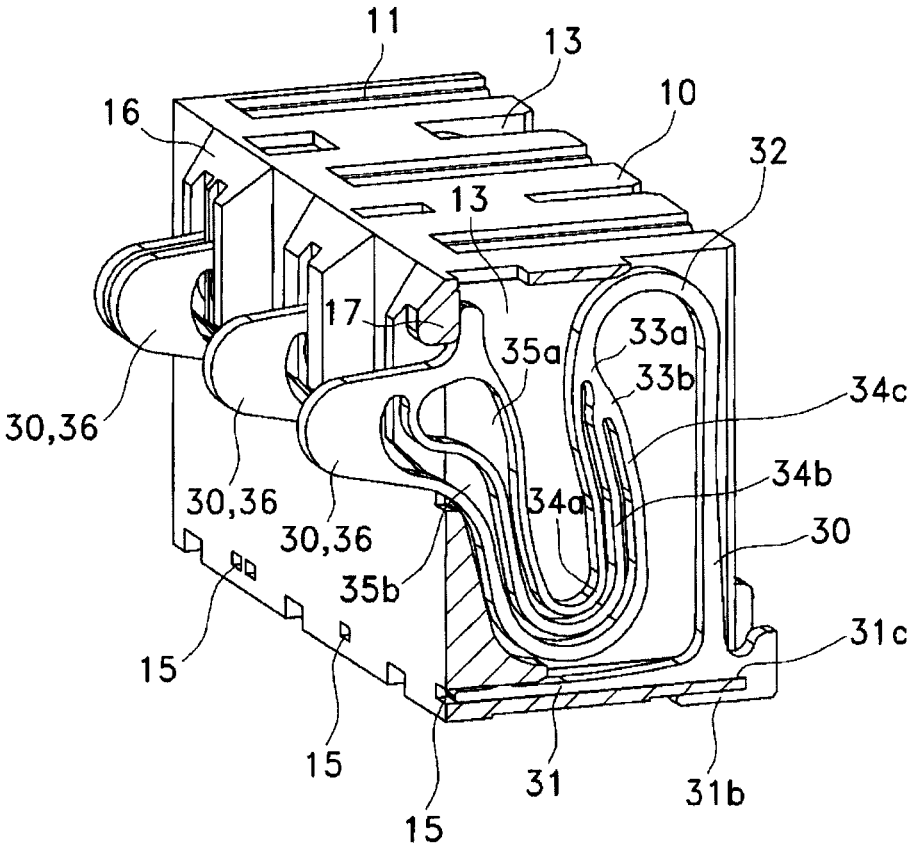
FIGS. 5A and 5B are a cross sectional perspective view of the connector in which the terminal according to the second embodiment illustrated in FIGS. 4A and 4B is incorporated, and a perspective view of a simple substance of the terminal.
Figure 5:
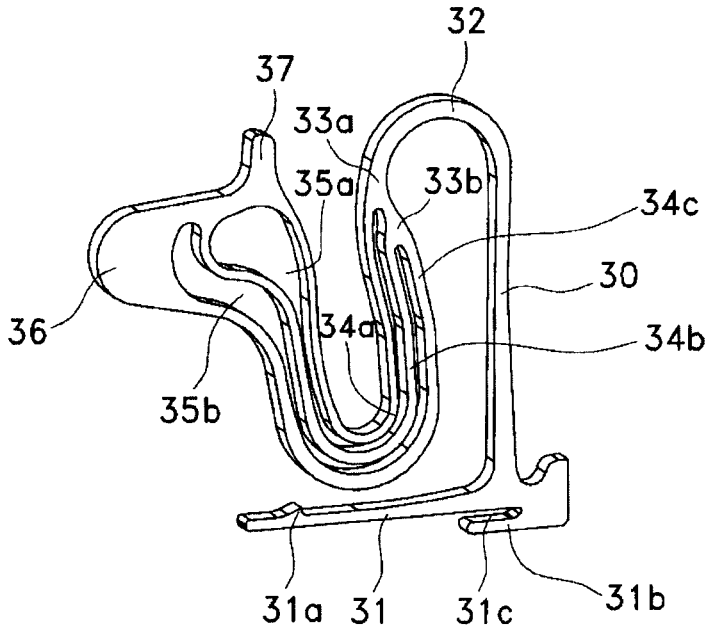
Figure 6:
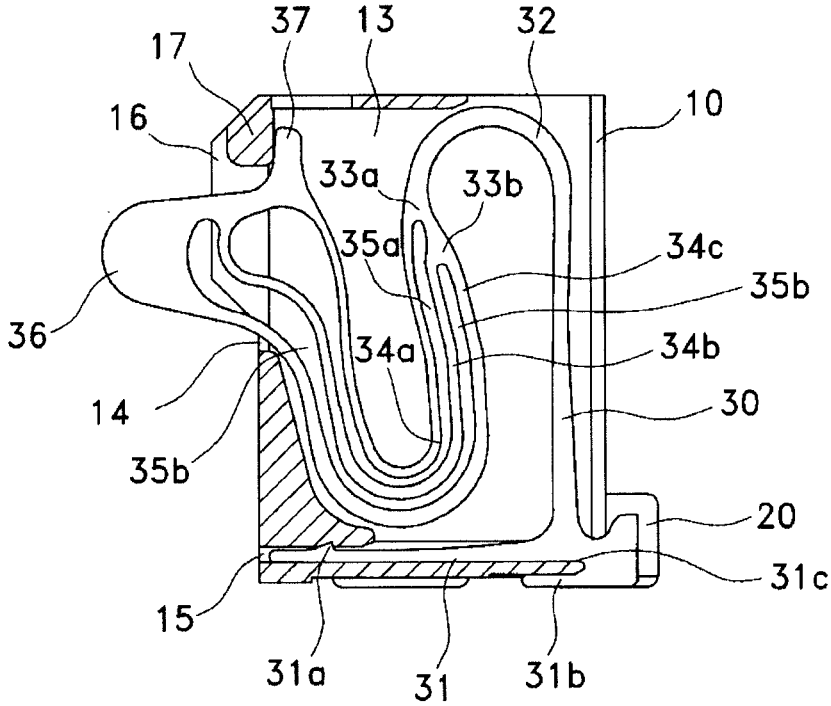
FIGS. 6A and 6B are cross sectional views showing before and after a motion of the terminal according to the second embodiment.
Figure 6:
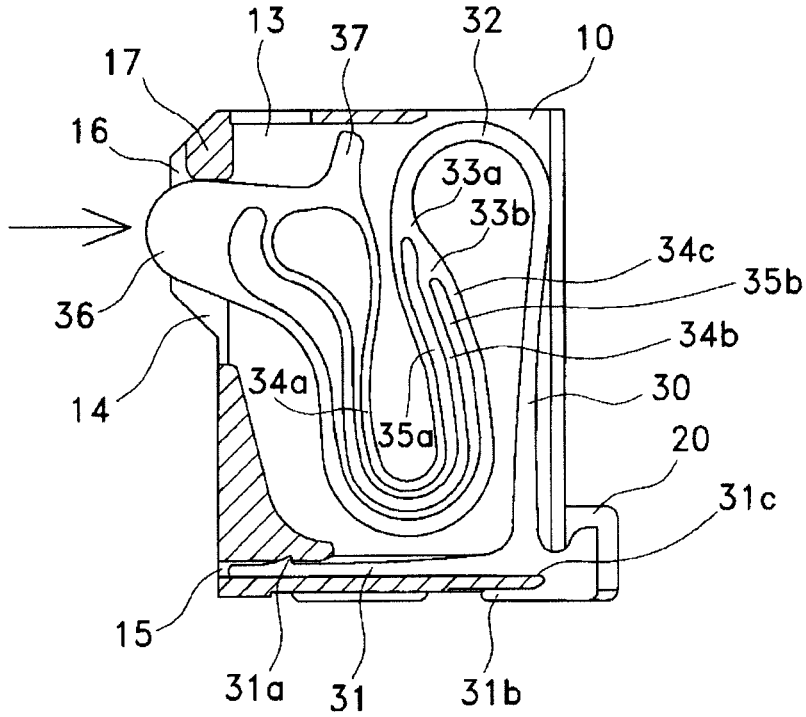
Figure 7:
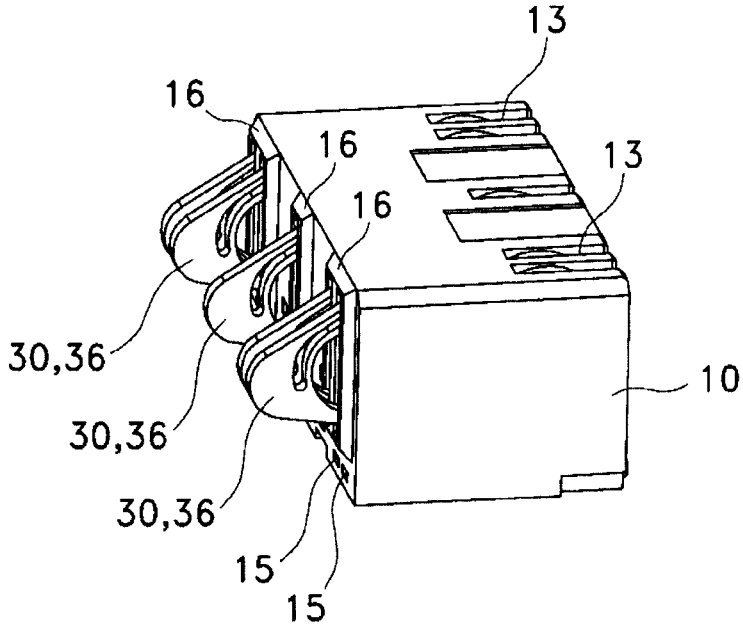
FIGS. 7A and 7B are a perspective view and a plan view each showing a connector in which a terminal according to a third embodiment of the present invention is incorporated.
Figure 7:
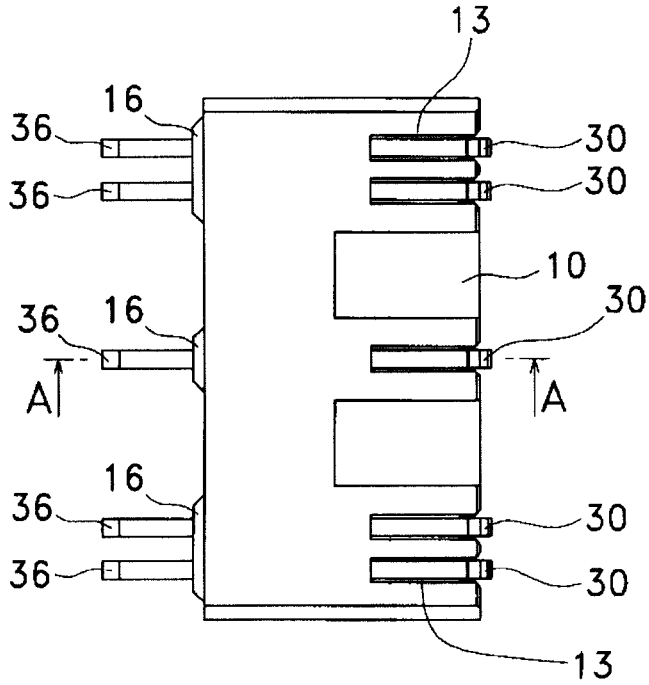
Figure 8:
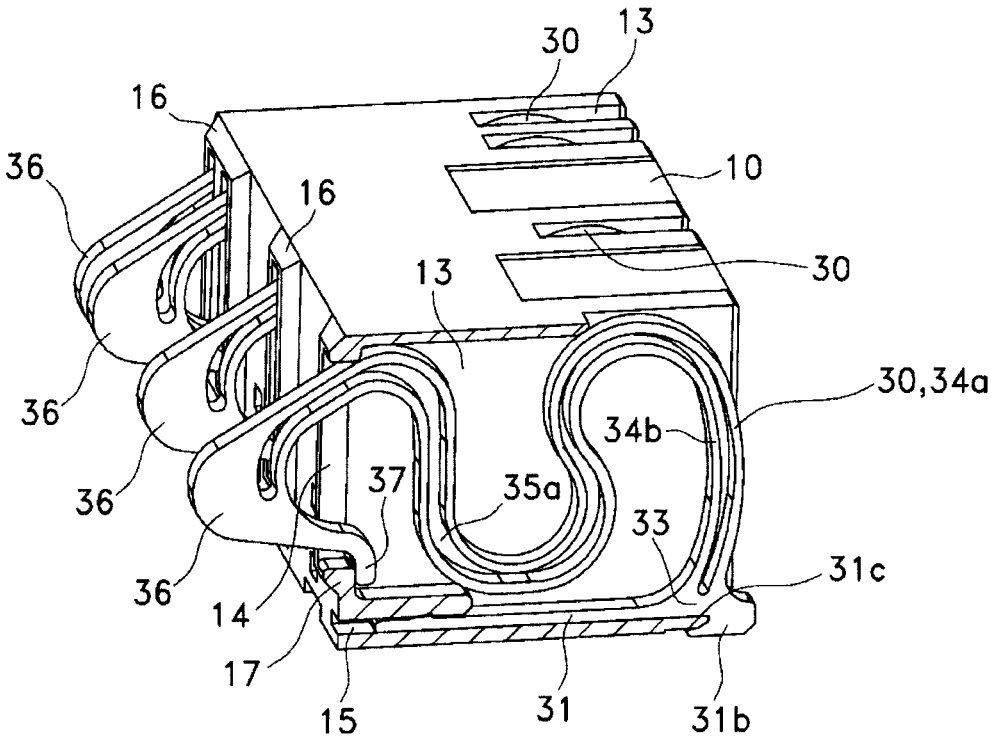
FIGS. 8A and 8B are a cross sectional perspective view of the connector in which the terminal according to the third embodiment illustrated in FIGS. 7A and 7B is incorporated, and a perspective view of a simple substance of the terminal.
Figure 8:
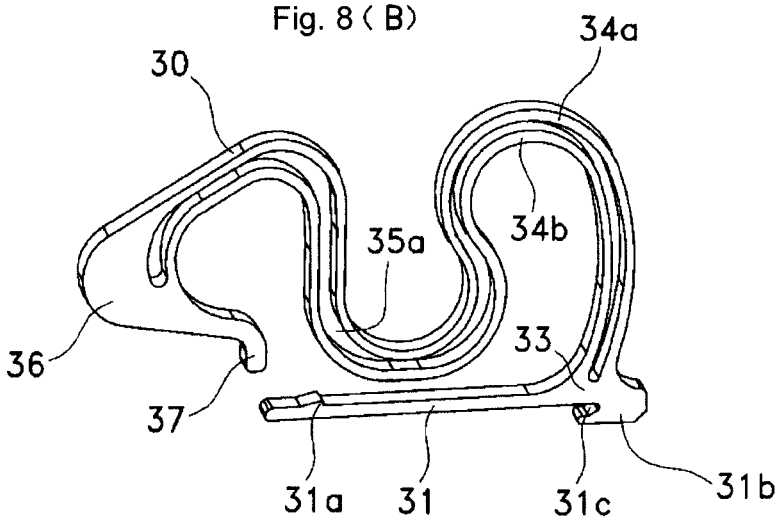
Figure 10:
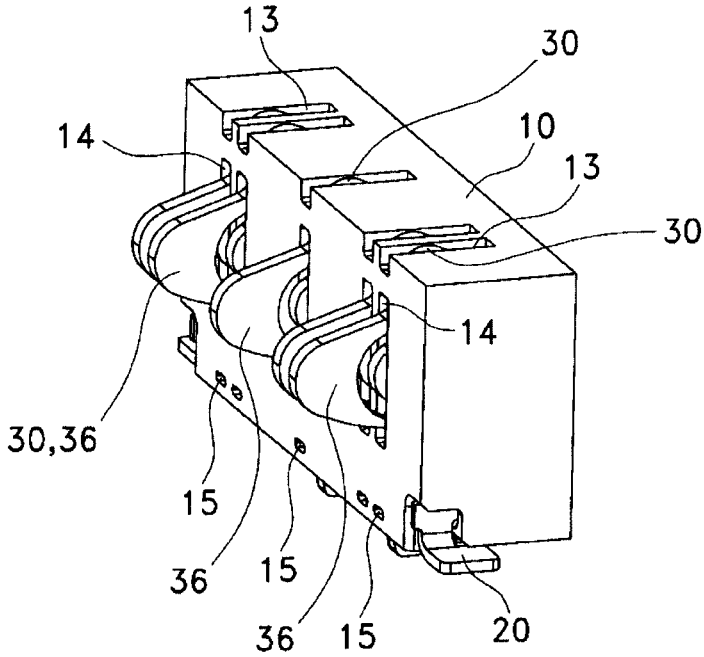
FIGS. 10A and 10B are a perspective view and a plan view each showing a connector in which a terminal according to a fourth embodiment of the present invention is incorporated.
Figure 10:
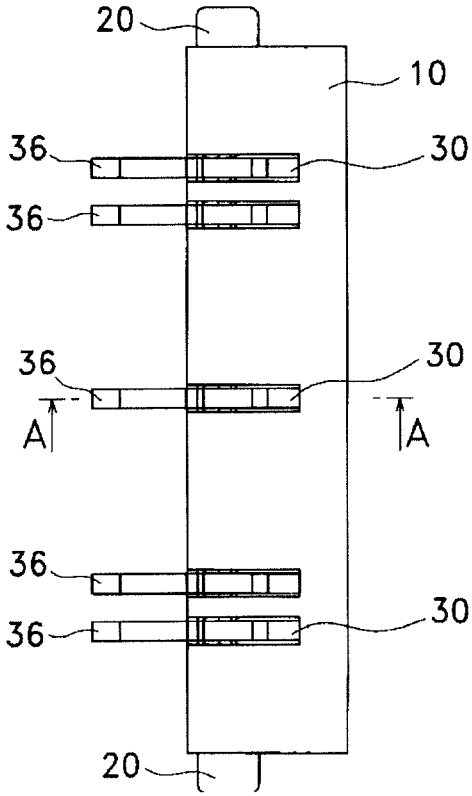
Figure 11:
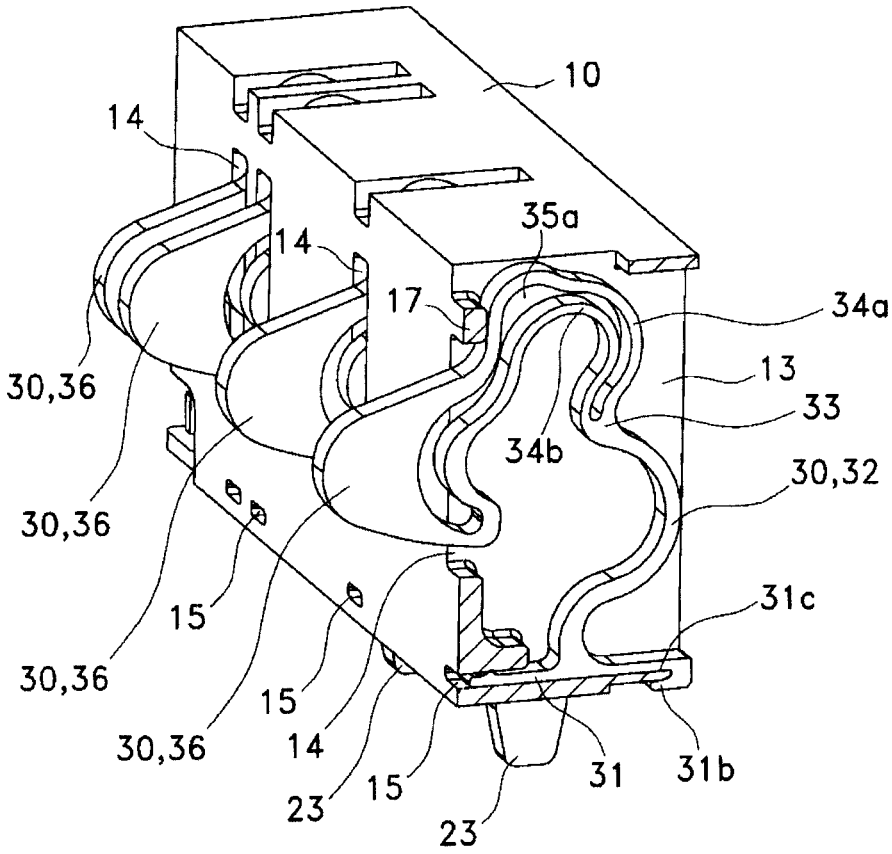
FIGS. 11A and 11B are a cross sectional perspective view of the connector in which the terminal according to the fourth embodiment illustrated in FIGS. 10A and 10B is incorporated, and a perspective view of a simple substance of the terminal.
Figure 11:
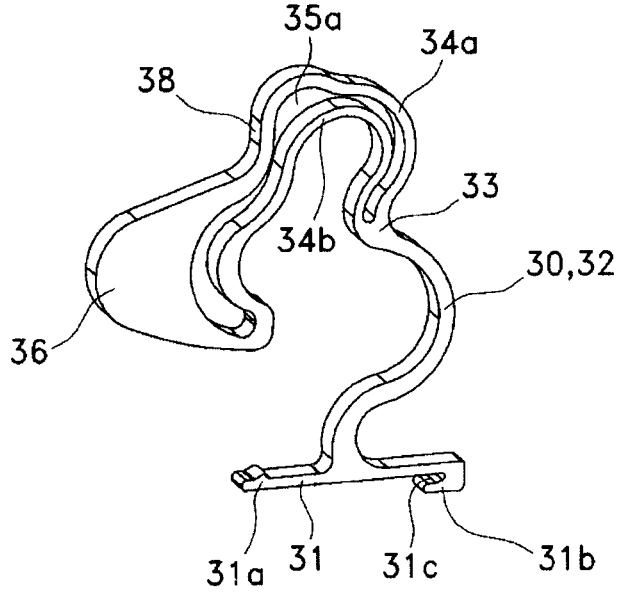
Figure 12:
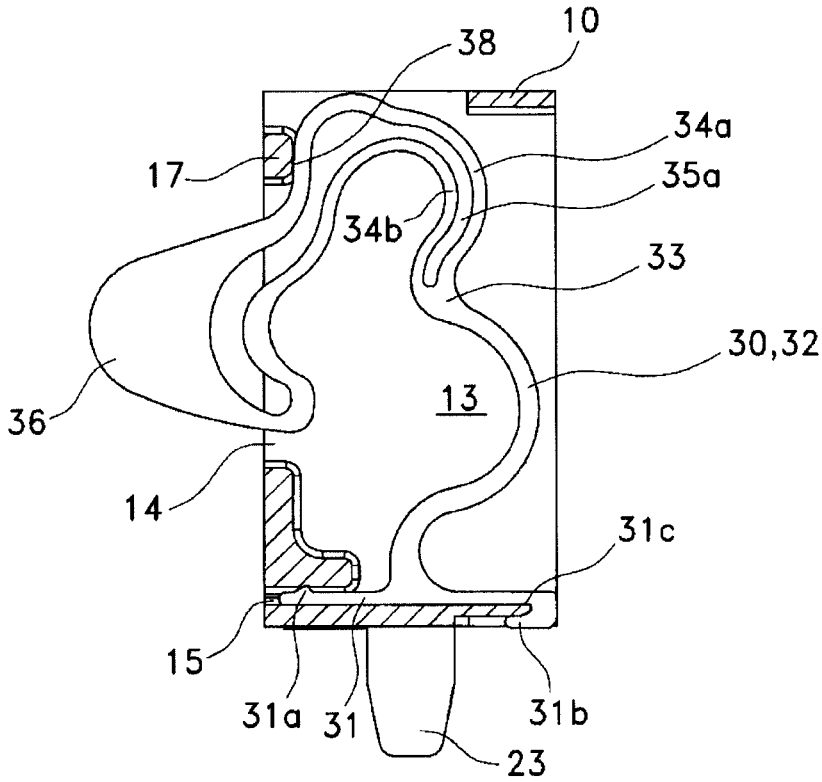
FIGS. 12A and 12B are cross sectional views showing before and after a motion of the terminal according to the fourth embodiment.
Figure 12:
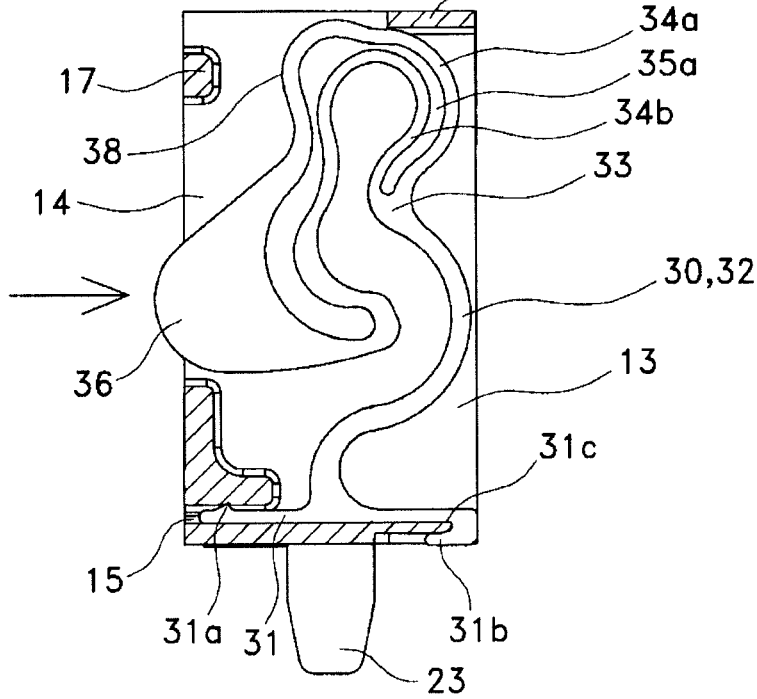
Figure 13:
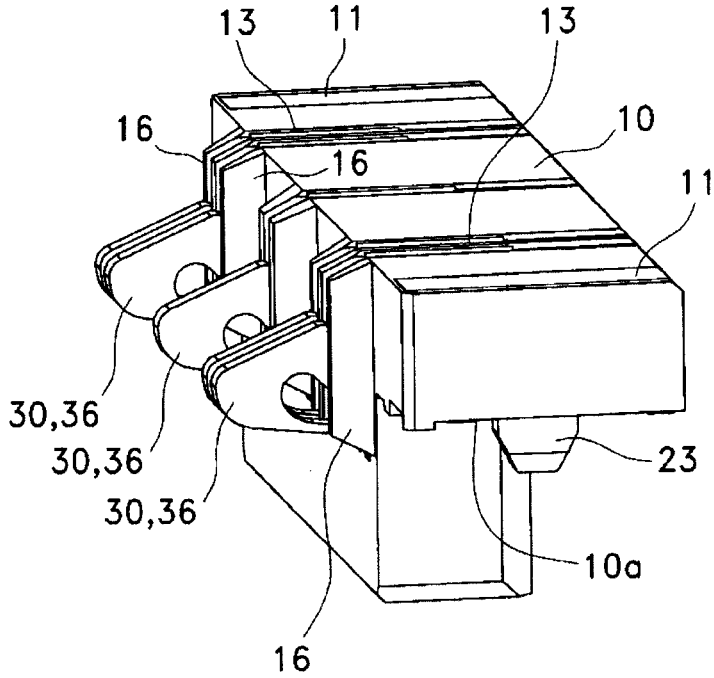
FIGS. 13A and 13B are a perspective view and a plan view each showing a connector in which a terminal according to a fifth embodiment of the present invention is incorporated.
Figure 13:
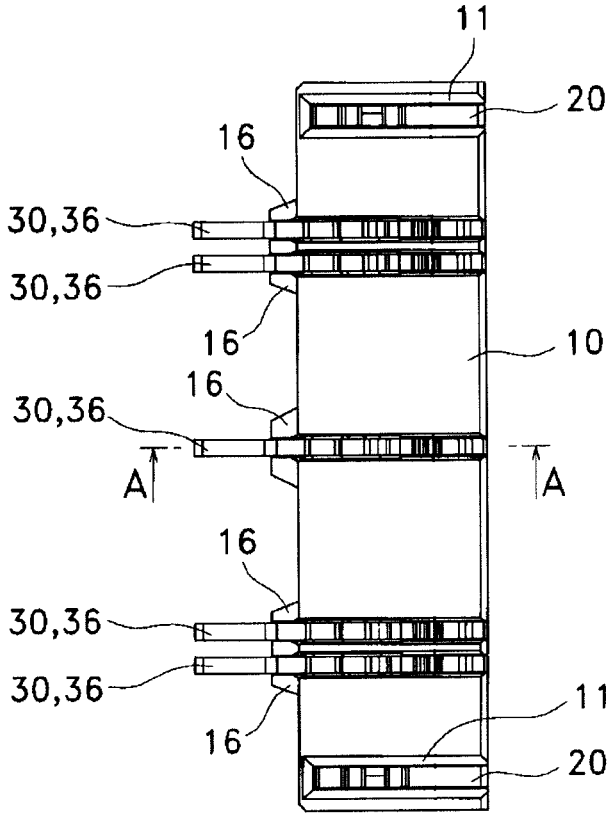
Figure 14:
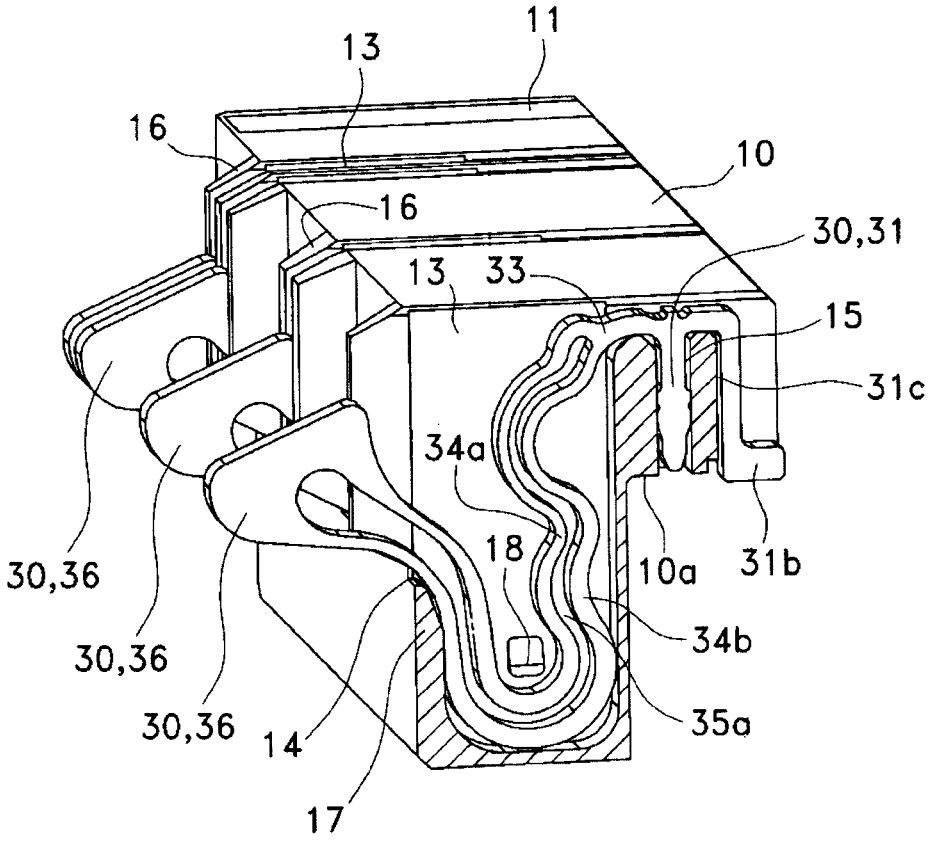
FIGS. 14A and 14B are a cross sectional perspective view of the connector in which the terminal according to the fifth embodiment illustrated in FIGS. 13A and 13B is incorporated, and a perspective view of a simple substance of the terminal.
Figure 14:
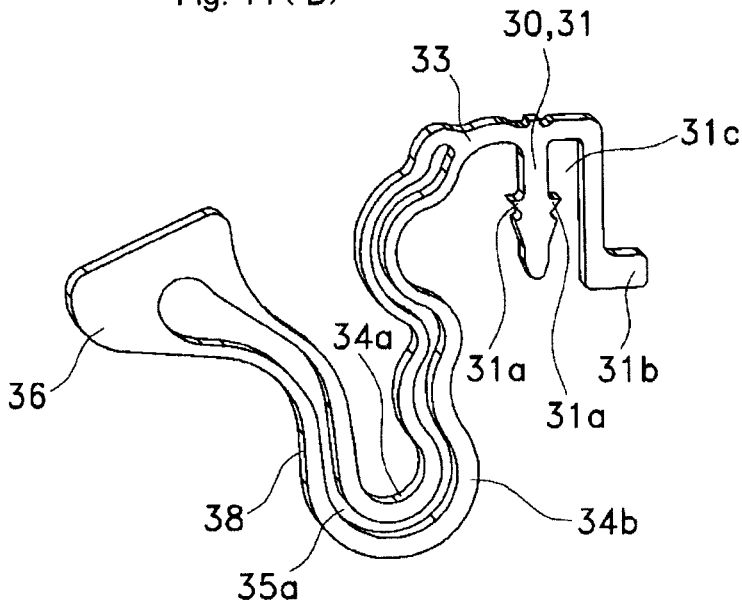
Figure 15:
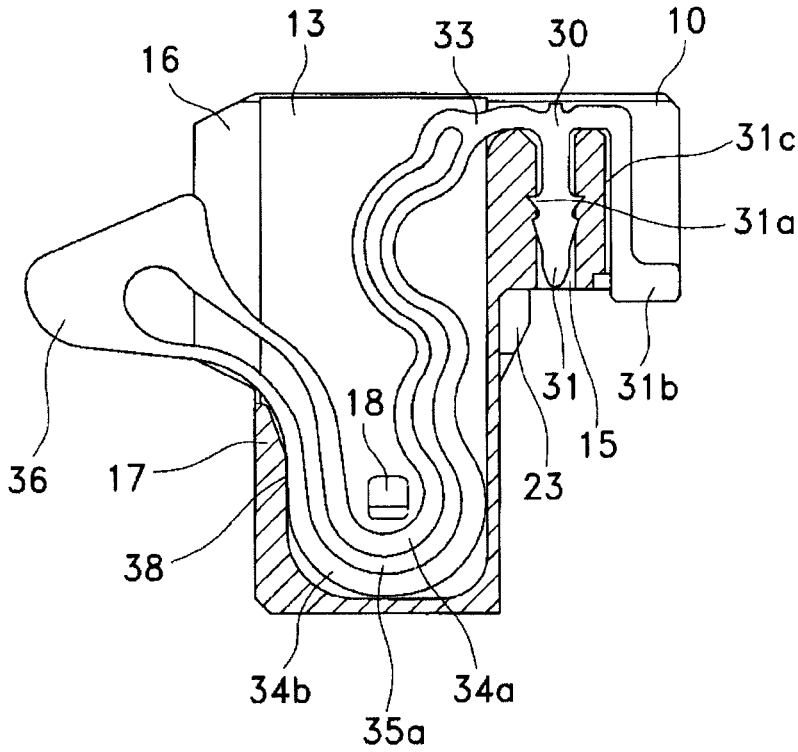
FIGS. 15A and 15B are cross sectional views showing before and after a motion of the terminal according to the fifth embodiment.
Figure 15:
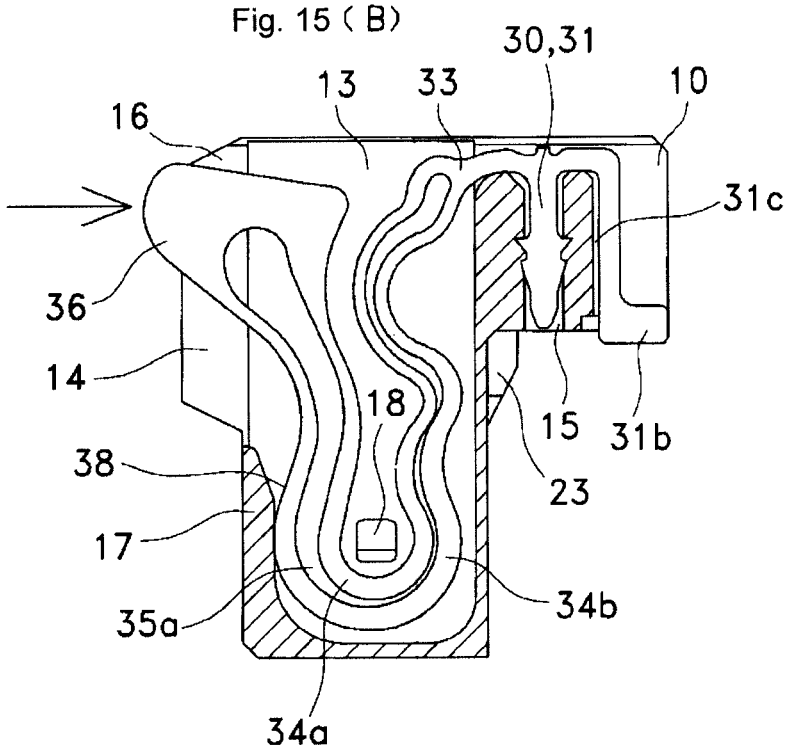

A description will be given of a terminal according to embodiments of the present invention with reference to accompanying FIGS. 1A to 15B. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

As shown in FIGS. 1A to 3B, a first embodiment is associated with a connector in which fixing brackets 20 are pressed into a resin-molded housing 10 having a height of 4 mm, and in which connection terminals 30 are pressed between the fixing brackets 20 and 20 at a predetermined pitch.

As shown in FIGS. 1A to 1C, the housing 10 is provided with a first storage space 11 in which the fixing bracket 20 can be pressed into the vicinity of both sides thereof and a center thereof from the above, and is also provided with locking protruding stripes 12 in opposing inner surfaces of the first storage space 11. Further, as shown in FIGS. 2A and 2B, the housing 10 is provided with a second storage space 13 in which a connection terminal 30 can be pressed into a portion between the first storage spaces 11 and 11 from a back face side. Further, the housing 10 is provided in a front face side thereof with a contacting hole 14 which is communicated with the second storage space 13 and can take in and out a movable contact portion 36 mentioned below, and with a press-fit hole 15 which is communicated with the second storage space 13. Reinforcing ribs 16 are provided in a protruding manner in opening edge portions in both sides of the contacting hole 14, and a position regulating receiving portion 17 is firmed in an upper edge portion of the contacting hole 14.

As shown in FIGS. 1A to 1C, the fixing bracket 20 is an approximately gate-shaped press molded product which is formed by punching a thin plate in a press work, and is provided in a protruding manner with a locking pawl 21 in an inner surface thereof. Accordingly, if the fixing bracket 20 is pressed into the first storage space 11 of the housing 10 from the above, the locking pawl 21 locks into the locking protruding stripe 12 of the housing 10, the fixing bracket 20 is prevented from coming off, and a fixing lower end portion 22 of the fixing bracket 20 is exposed in such a manner that it can be connected and fixed from a bottom surface of the housing 10 (FIGS. 3A and 3B).

The connection terminal 30 is provided with a branch portion 33 at an end of an approximately J-shaped support portion 32 which protrudes upward from a press-fit fixing portion 31, as shown in FIGS. 2A and 2B. Further, the press-fit fixing portion 31 is provided in a protruding manner with a locking pawl 31*a* in an upper surface of one end portion thereof, and is provided with a connection portion 31*b* from a lower surface of the other end portion thereof, thereby forming a press-fit notch portion 31*c*. Further, first and second slits 35*a* and 35*b* are formed by extending first, second, and third extension portions 34*a*, 34*b*, and 34*c* which meander approximately in parallel from the branch portion 33. Further, a movable contact portion 36 is provided in a free end portion which is formed by integrating tip portions of the first, second, and third extension portions 34*a*, 34*b*, and 34*c*. Further, a position regulating protrusion portion 37 is provided in a protruding manner in an end of the first extension portion 34*a*.

In this case, in one or more embodiments, width dimensions in curved portions of the first, second, and third extension portions 34*a*, 34*b*, and 34*c* are enlarged sequentially. Accordingly, stress concentration at the time of operating is hard to be generated, and there is such an advantage that a service life is elongated.

Further, width dimensions of the first and second slits 35*a* and 35*b* according to one or more embodiments are set to such a dimension that the first, second, and third extension portions 34*a*, 34*b*, and 34*c* do not come into contact with each other even if the movable contact portion 36 of the connection terminal 30 is actuated. Accordingly, the first, second, and third extension portions 34*a*, 34*b*, and 34*c* do not come into contact with each other at the time of a predetermined operation, and any uncomfortable contact sound is not generated.

Further, as shown in FIGS. 3A and 3B, it is possible to fix by inserting the connection terminal 30 to the second storage space 13 of the housing 10 from a back face side, pressing the press-fit fixing portion 31 into the press-fit hole 15, locking the locking pawl 31*a* to the inner surface of the press-fit hole 15, and engaging the notch portion 31*c* with the edge portion of the housing 10. Further, the position regulating protrusion portion 37 of the connection terminal 30 comes into contact with the position regulating receiving portion 17 of the housing 10 so as to be regulated its position, and the connection portion 31*b* of the connection terminal 30 becomes flush with the fixing lower end portion 22 of the fixing bracket 20.

If the movable contact portion 36 is pressed in, for example, by bringing a battery of a portable electronic device into pressure contact with the connector mounted on a printed circuit board (not illustrated), the first, second, and third extension portions 34*a*, 34*b*, and 34*c* are elastically deformed, and the support portion 32 is elastically deformed. Further, since the width dimensions of the first and second slits 35*a* and 35*b* are made large within a range of a predetermined amount of pressing, the first, second, and third extension portions 34*a*, 34*b*, and 34*c* do not come into contact with each other, and a friction sound is not generated. In particular, the meandering first, second, and third extension portions 34*a*, 34*b*, and 34*c* and the support portion 32 are arranged between the movable contact portion 36 and the press-fit fixing portion 31, the spring length is long, it is possible to secure a desired displacement amount, and stress concentration is hard to be generated. Accordingly, contact reliability is improved, and there is such an advantage that a connector having a long service life can be obtained.

A second embodiment is approximately the same as the first embodiment mentioned above, as shown in FIGS. 4A to 6B, and a different point is that connecting structures of the first, second, and third extension portions 34*a*, 34*b*, and 34*c* are different.

In other words, as shown in FIGS. 5A and 5B, the connection terminal 30 according to one or more embodiments is structured such that the first extension portion 34*a* and the second branch portion 33*b* extend from the first branch portion 33*a* which is positioned in the end of the support portion 32, and the second and third extension portions 34*b* and 34*c* are branched from the second branch portion 33*b*. Therefore, there are such advantages that the stress concentration with respect to the branch portions 33*a* and 33*b* is further hard to be generated, the service life is extended, and a freedom of a design is widened.

Since the other is approximately the same as the first embodiment, the same reference numerals are attached to the same portions and a description will be omitted.

A third embodiment is approximately the same as the first embodiment as shown in FIGS. 7A to 9B, and a different point is that the first storage space 11 incorporating the fixing bracket 20 is not provided in the housing 10, but the position regulating receiving portion 17 is arranged in a downward edge portion of the contacting hole 14.

Further, the connection terminal 30 according to the third embodiment is structured, as shown in FIGS. 8A and 8B, such that the first slit 35*a* is formed by extending the first and second extension portions 34*a* and 34*b* which meander approximately in parallel from the branch portion 33 provided in the press-fit fixing portion 31. Further, the movable contact portion 36 is provided in a free end portion which is formed by integrating the tip portions of the first and second extension portions 34*a* and 34*b*. Further, the width dimension of the first slit 35*a* according to one or more embodiments comes to such a gap that the first and second extension portions 34*a* and 34*b* do not come into contact with each other even if the movable contact portion 36 of the connection terminal 30 is actuated. Further, the position regulating protrusion portion 37 is provided in a protruding manner at the tip portion of the movable contact portion 36.

Accordingly, as shown in FIGS. 9A and 9B, it is possible to achieve a come-off prevention by inserting the connection terminal 30 into the second storage space 13 of the housing 10 from the back face side, pressing the press-fit fixing portion 31 into the press-fit hole 15, locking the locking pawl 31*a* to the inner surface of the press-fit hole 15, and engaging the notch portion 31*c* with the edge portion of the housing 10. Further, the position regulating protrusion portion 37 of the connection terminal 30 comes into contact with the position regulating receiving portion 17 of the housing 10 so as to be regulated its position.

Further, if the movable contact portion 36 is pressed in, for example, by bringing the battery of the portable electronic device into pressure contact with the connector mounted on the printed circuit board (not illustrated), the first and second extension portions 34*a* and 34*b* are elastically deformed. At this time, since the width dimension of the first slit 35*a* is made large within a range of a predetermined amount of pressing, the first and second extension portions 34*a* and 34*b* do not come into contact with each other, a friction sound is not generated, and a smooth motion can be achieved. In particular, in one or more embodiments, the first and second extension portions 34*a* and 34*b* between the movable contact portion 36 and the press-fit fixing portion 31 meander widely, the spring length is long, and stress concentration is hard to be generated. Accordingly, there are such advantages that contact reliability is high, and a connector having a long service life can be obtained.

In this case, since the other is approximately the same as the embodiment mentioned above, the same reference numerals are attached to the same portions and a description will be omitted.

As shown in FIGS. 10A to 12B, a fourth embodiment is associated with a connector in which the connection terminal 30 is incorporated in the housing 10 which is vertically long in cross-section.

The housing 10 is structured, as shown in FIGS. 10A and 10B, such that the fixing bracket 20 is pressed into first storage spaces (not shown) which are arranged in both side edge portions of a bottom surface thereof, and the second storage space 13 into which the connection terminal 30 can be pressed from the back face side is provided between the first storage spaces (FIGS. 11A and 11B). Further, the housing 10 is structured such that a fixing bracket 23 which can be inserted into a through hole of the printed circuit board is pressed into the bottom surface thereof. Further, the housing 10 is provided in its front face side with the contacting hole 14 which is communicated with the second storage space 13 and can take a movable contact portion 36 mentioned below in and out, and with the press-fit hole 15 which is communicated with the second storage space 13. Further, the position regulating receiving portion 17 is formed in an upward edge portion of the contacting hole 14.

The connection terminal 30 is structured, as shown in FIGS. 11A and 11B, such that the branch portion 33 is provided in the end of the curved support portion 32 which protrudes upward from the press-fit fixing portion 31. Further, the locking pawl 31*a* is provided in a protruding manner on an upper face of one end portion, and the connection portion 31*b* is provided from a lower face of the other end portion thereof, in the press-fit fixing portion 31, whereby the press-fit notch portion 31*c* is formed. Further, the first slit 35*a* is formed by extending the first and second extension portions 34*a* and 34*b* which meander approximately in parallel from the branch portion 33. Further, the movable contact portion 36 is provided in the free end portion which is formed by integrating the tip portions of the first and second extension portions 34*a* and 34*b*. Further, one or more embodiments is structured such that a position regulation is achieved by bringing the position regulating contact portion 38 of the first extension portion 34*a* into contact with the position regulating receiving portion 17 of the housing 10.

In this case, the width dimension of the first slit 35*a* according to one or more embodiments comes to such a gap that the first and second extension portions 34*a* and 34*b* do not come into contact with each other even if the movable contact portion 36 of the connection terminal 30 is actuated. Accordingly, there are such advantages that no contact is generated at the time of a predetermined operation, and any uncomfortable contact sound is not generated.

Further, as shown in FIGS. 11A and 11B, it is possible to achieve the come-off prevention by inserting the connection terminal 30 into the second storage space 13 of the housing 10 from the back face side, pressing the press-fit fixing portion 31 into the press-fit hole, locking the locking pawl 31*a* to the inner face of the press-fit hole 15, and engaging the notch portion 31*c* with the edge portion of the housing 10. Further, the position regulating contact portion 38 of the connection terminal 30 comes into contact with the position regulating receiving portion 17 of the housing 10 so as to be regulated its position.

If the movable contact portion 36 of the connector mounted on the printed circuit board (not illustrated) is pressed in, the first and second extension portions 34*a* and 34*b* are elastically deformed, and the support portion 32 is elastically deformed. At this time, since the width dimension of the first slit 35*a* is made large within the range of the predetermined amount of pressing, the first and second extension portions 34*a* and 34*b* do not come into contact with each other, and any friction sound is not generated. In particular, the support portion 32 and the first and second extension portions 34*a* and 34*b* are arranged between the movable contact portion 36 and the press-fit fixing portion 31, the spring length is long, and the stress concentration is hard to be generated. Accordingly, there are such advantages that the contact reliability is high, and the connector having the long service life can be obtained.

In particular, according to one or more embodiments, since the support portion 32 is curved to the outer side even if the movable contact portion 36 is pushed to the inner side, the second extension portion 34*b* do not come into contact with the support portion 32. Accordingly, there is such an advantage that a connector which is vertically long and is small in a floor area can be obtained.

As shown in FIGS. 13A to 15B, a fifth embodiment is associated with a connector in which the connection terminal 30 is incorporated in the housing 10 which has an approximately L-shaped attaching step portion 10*a* in a lower face edge portion.

The housing 10 is structured, as shown in FIGS. 13A and 13B, such that the approximately L-shaped attaching step portion 10*a* is formed in the edge portion of its bottom face, and the first storage spaces 11 into which the fixing bracket 23 can be pressed from the above are provided in the vicinity of both sides thereof. Further, as shown in FIGS. 14A and 14B, the housing 10 is provided between the first storage spaces 11 with the second storage space 13 into which the connection terminal can be pressed from the above side. Further, the housing 10 is provided in its front face side with the contacting hole 14 which is communicated with the second storage space 13 and can take in and out a movable contact portion 36 mentioned below, and is provided with the press-fit hole 15 which is communicated with the second storage space 13. The reinforcing ribs 16 are provided in a protruding manner in both sides of an opening edge portion of the contacting hole 14. Further, a lower side edge portion of the contacting hole 14 is formed as the position regulating receiving portion 17, and the come-off preventing projection 18 is provided in a protruding manner in an inner side surface of the second storage space 13.

The connection terminal 30 is structured, as shown in FIGS. 14A and 14B, such that the branch portion 33 is extended in one side of one end portion of the press-fit fixing portion 31 which is provided in a protruding manner with the locking pawls 31*a* in both side edge portions, and the press-fit notch portion 31*c* is formed by extending the connection portion 31*b* from the other side. Further, the first slit 35*a* is formed by extending the first and second extension portions 34*a* and 34*b* which meander approximately in parallel from the branch portion 33. Further, the movable contact portion 36 is provided in a free end which is formed by integrating the tip portions of the first and second extension portions 34*a* and 34*b*. Further, one or more embodiments is structured such that a position regulation is achieved by bringing the position regulating contact portion 38 of the second extension portion 34*b* into contact with the position regulating receiving portion 17.

In this case, in one or more embodiments, the width dimensions in the curved portions of the first and second extension portions 34*a* and 34*b* are made larger sequentially. Accordingly, there is such an advantage that the stress concentration is hard to be generated at the time of the operation, and the service life is extended.

The width dimension of the first slit 35*a* according to one or more embodiments comes to a gap by which the first and second extension portions 34*a* and 34*b* do not come into contact with each other even by actuating the movable contact portion 36 of the connection terminal 30. Accordingly, there is such an advantage that any contact is generated at the time of the predetermined operation, and any uncomfortable contact sound is not generated.

Further, as shown in FIGS. 15A and 15B, a come-off prevention is achieved by inserting the connection terminal 30 into the second storage space 13 of the housing 10 from the above, pressing the press-fit fixing portion 31 into the press-fit hole 15, locking the locking pawl 31*a* to the inner surface of the press-fit hole 15, and engaging the notch portion 31*c* with the edge portion of the housing 10. Further, after the first and second extension portions 34*a* and 34*b* get over the come-off preventing projection 18, the position regulating contact portion 38 of the second extension portion 34*b* comes into contact with the position regulating receiving portion 17 of the housing 10 so as to be regulated its position.

If the connector is mounted on the upper face edge portion of the notched corner portion of the printed circuit board (not illustrated) and the movable contact portion 36 is pushed to the inner side, for example, by bringing the battery (not illustrated) into pressure contact, the first and second extension portions 34*a* and 34*b* are elastically deformed. At this time, since the width dimension of the first slit 35*a* is made large within the range of the predetermined compressing amount, the first and second extension portions 34*a* and 34*b* do not come into contact with each other, and the first extension portions 34*a* do not come into contact with each other, a smooth motion can be achieved without generating any friction sound.

In this case, in the embodiment mentioned above, a description has been given of a case that one set of two connection terminals and one connection terminal are combined for enhancing the contact reliability, however, all may be configured only by one connection terminal, and all may be configured by one set of two connection terminals. Further, one set of three connection terminals may be incorporated, and obviously the number of the connection terminals can be selected if required.

Further, it is not necessary that the extension portions and the slits have the uniform width dimensions, but the width dimension may be changed if required. For example, durability may be enhanced by making only the width dimension of the curved portion of the extension portion positioned in the outer side large so as to prevent the stress concentration from being generated.

Further, in the embodiment mentioned above, the description has been given of the case that the connection terminal is incorporated in the housing serving as the base material, however, the printed circuit board may be set to the base material, and the connection terminal according to the present application may be directly incorporated in the side end surface thereof. Accordingly, there is such an advantage that the housing and the fixing bracket are not necessary, as a result, it is possible to make a whole of the apparatus further compact.

The terminal according to the present invention is not limited to the shape mentioned above.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF SYMBOLS

10: Base
13: Second storage space
14: Contacting hole
17: Position regulating receiving portion
20, 23: Fixing bracket
30: Connection terminal
31: Press-fit fixing portion
32: Support portion
33: Branch portion
34*a*, 34*b*, 34*c*: First, second and third extension portions
35*a*, 35*b*: First and second slits
36: Movable contact portion
37: Position regulating protrusion portion
38: Position regulating contact portion

The invention claimed is:

1. A terminal configured to be pressed into and fixed to a base material, comprising:
- a press-fit fixing portion configured to be pressed into the base material;
- a branch portion extending from the press-fit fixing portion;
- a plurality of extension portions that extend from the branch portion in a meandering manner, such that at least one meandering slit is formed thereby;
- a tip portion integrated with a free end of at least one of the extension portions; and
- a movable contact portion formed on the tip portion that is configured to protrude out of a contacting hole of the base material so as to be taken in and out,
- wherein each of the extension portions has a curved elbow-shaped intermediate portion,
- wherein, at the intermediate portion, width dimensions of the adjacent extension portions is varied, and
- wherein a width dimension of the at least one slit is a width dimension that the adjacent extension portions do not come into contact with each other at the time of operating.

2. The terminal according to claim 1, wherein the branch portion is provided in an end of a support portion which is provided in a protruding manner in such a manner as to intersect the press-fit fixing portion.

3. A terminal configured to be pressed into and fixed to a base material, comprising:
- a press-fit fixing portion configured to be pressed into the base material;
- a branch portion extending from the press-fit fixing portion;
- a plurality of extension portions that extend from the branch portion in a meandering manner, such that at least one meandering slit is formed thereby;
- a tip portion integrated with a free end of the extension portion; and
- a movable contact portion formed on the tip portion that is configured to protrude out of a contacting hole of the base material so as to be taken in and out,
- wherein a branch portion is provided in an end of a support portion which is provided in a protruding manner in such a manner as to intersect the press-fit fixing portion, and
- wherein the support portion is curved.

4. The terminal according to claim 1, wherein three extension portions are extended from the branch portion.

5. The terminal according to claim 4, wherein one end portion of each of first, second, and third extension portions extending from the branch portion are positioned on a same straight line.

6. A terminal configured to be pressed into and fixed to a base material, comprising:
- a press-fit fixing portion configured to be pressed into the base material;

a branch portion extending from the press-fit fixing portion;

a plurality of extension portions that extend from the branch portion in a meandering manner, such that at least one meandering slit is formed thereby;

a tip portion integrated with a free end of the extension portion; and a movable contact portion formed on the tip portion that is configured to protrude out of a contacting hole of the base material so as to be taken in and out, wherein three extension portions are extended from the branch portion, and wherein a first extension portion and a second branch portion extend from a first branch portion which is provided in the press-fit fixing portion, and a second extension portion and a third extension portion extend from the second branch portion.

7. The terminal according to claim 1, wherein a substantial portion of a total length of the adjacent extension portions extend in parallel.

8. The terminal according to claim 6, wherein the adjacent extension portions extend in parallel.

9. The terminal according to claim 1, wherein the tip portion with which the extension portion is integrated is provided in a protruding manner with a position regulating protrusion portion which comes into contact with a position regulating receiving portion of the base material.

10. The terminal according to claim 1, wherein the tip portion with which the extension portion is integrated is provided with a position regulating contact portion which comes into contact with the position regulating receiving portion of the base material.

11. A connector wherein the press-fit fixing portion of the terminal according to claim 1 is pressed into a press-fit hole of a housing serving as the base material so as to be fixed, and the movable contact portion of the terminal protrudes out of a contacting hole provided in the housing so as to be taken in and out.

12. The connector according to claim 11, wherein a position regulating protrusion portion which is provided in a protruding manner around a movable contact portion of the terminal is brought into contact with a position regulating receiving portion which is provided in an opening edge portion of the contacting hole of the housing so as to be positioned.

13. The connector according to claim 11, wherein a position regulating contact portion which is provided around a movable contact portion of the terminal is brought into contact with a position regulating receiving portion which is provided in an opening edge portion of the contacting hole of the housing so as to be positioned.

14. The terminal according to claim 2, wherein three extension portions are extended from the branch portion.

15. The terminal according to claim 3, wherein three extension portions are extended from the branch portion.

16. The terminal according to claim 2, wherein the adjacent extension portions extend in parallel.

17. The terminal according to claim 3, wherein the adjacent extension portions extend in parallel.

18. The terminal according to claim 4, wherein the adjacent extension portions extend in parallel.

19. The terminal according to claim 5, wherein the adjacent extension portions extend in parallel.

* * * * *